US010975856B2

(12) United States Patent
Mou et al.

(10) Patent No.: US 10,975,856 B2
(45) Date of Patent: Apr. 13, 2021

(54) GAS TRANSPORTATION DEVICE

(71) Applicant: Microjet Technology Co., Ltd., Hsinchu (TW)

(72) Inventors: Hao-Jan Mou, Hsinchu (TW); Chi-Feng Huang, Hsinchu (TW); Wei-Ming Lee, Hsinchu (TW); Hsien-Chung Tai, Hsinchu (TW); Yung-Lung Han, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 204 days.

(21) Appl. No.: 16/058,111

(22) Filed: Aug. 8, 2018

(65) Prior Publication Data

US 2019/0085839 A1 Mar. 21, 2019

(30) Foreign Application Priority Data

Sep. 15, 2017 (TW) ..... 106131784

(51) Int. Cl.
*F04B 45/047* (2006.01)
*F04B 53/10* (2006.01)
(Continued)

(52) U.S. Cl.
CPC ..... *F04B 45/047* (2013.01); *F04B 39/1066* (2013.01); *F04B 43/046* (2013.01);
(Continued)

(58) Field of Classification Search
CPC ..... F04B 45/04; F04B 45/043; F04B 45/047; F04B 45/10; F04B 53/16; F04B 39/123;
(Continued)

(56) References Cited

U.S. PATENT DOCUMENTS

2012/0171062 A1* 7/2012 Kodama ..... F04B 19/006 417/413.2
2013/0071273 A1* 3/2013 Locke ..... F04B 45/045 417/480
2015/0059749 A1* 3/2015 Nitta ..... F04B 49/007 128/204.18

FOREIGN PATENT DOCUMENTS

CN 1247593 A 3/2000
CN 1399070 A 2/2003
(Continued)

OTHER PUBLICATIONS

"Automotive Microelectronics", Jul. 31, 2015, pp. 11-15 ( 6 pages total), with an English abstract.

*Primary Examiner* — Devon C Kramer
*Assistant Examiner* — David N Brandt
(74) *Attorney, Agent, or Firm* — Birch, Stewart, Kolasch & Birch, LLP

(57) ABSTRACT

A gas transportation device is provided and includes a plurality of flow guiding units. Each of the flow guiding units includes an inlet plate, a substrate, a resonance plate, an actuating plate, a piezoelectric component, an outlet plate and a valve, which are sequentially stacked. A convergence chamber is formed between the resonance plate and the inlet plate. The actuating plate has a suspension part, an outer frame and a plurality of interspaces. The piezoelectric component is attached on a surface of the suspension part. Gas is inhaled into the convergence chamber via an inlet aperture of the inlet plate, is transported into a first chamber via a central aperture of the resonance plate, is further transported into a second chamber via the interspaces, and is discharged out from an outlet aperture of the outlet plate. The gas is transported by the flow guiding units disposed in a specific arrangement.

5 Claims, 13 Drawing Sheets

(51) Int. Cl.

| | |
|---|---|
| ***F04B 43/04*** | (2006.01) |
| ***F04B 45/04*** | (2006.01) |
| ***F04B 45/10*** | (2006.01) |
| ***F04B 39/10*** | (2006.01) |

(52) U.S. Cl.
CPC ..... *F04B 53/10* (2013.01); *F04B 45/045* (2013.01); *F04B 45/10* (2013.01)

(58) Field of Classification Search
CPC .... F04B 39/121; F04B 43/043; F04B 43/046; F16K 31/004; F16K 31/02
See application file for complete search history.

(56) References Cited

FOREIGN PATENT DOCUMENTS

| | | | |
|---|---|---|---|
| CN | 101550927 | A | 10/2009 |
| CN | 102459899 | A | 5/2012 |
| CN | 104302913 | A | 1/2015 |
| CN | 205503415 | U | 8/2016 |
| EP | 3456967 | A1 | 3/2019 |
| JP | 2011-241808 | A | 12/2011 |

* cited by examiner

GAS TRANSPORTATION DEVICE

FIELD OF THE INVENTION

The present disclosure relates to a gas transportation device, and more particularly to a miniature, thin and silent gas transportation device.

BACKGROUND OF THE INVENTION

Currently, in all fields, the products used in many sectors such as pharmaceutical industries, computer techniques, printing industries or energy industries are developed toward elaboration and miniaturization. The gas transportation devices are important components that are used in, for example, micro pumps. Therefore, how to utilize an innovative structure to break through the bottleneck of the prior art has become an important part of development.

With the rapid advancement of science and technology, the application of gas transportation device tends to be more and more diversified. For the industrial applications, the biomedical applications, the healthcare, the electronic cooling and so on, even the most popular wearable devices, the gas transportation device is utilized therein. It is obviously that the conventional gas transportation devices gradually tend to miniaturize the structure and maximize the flow rate thereof.

In the prior art, the gas transportation device is mainly constructed by stacking the conventional mechanism components. Moreover, the miniaturization and thinning of the entire device are achieved by minimizing or thinning each mechanism component. However, while miniaturizing the structure of the conventional mechanism components, it is difficult to control the dimensional accuracy and the assembly accuracy. As a result, the product yield rate is unstable. Moreover, it even results in an unstable flow of gas transportation.

Furthermore, the conventional gas transportation device also has the problem of insufficient amount of the transportation. It is difficult to meet the requirements of transporting a great amount of gas by a solo gas transportation device. Moreover, the conventional gas transportation devices usually have conducting pins protruding outwardly for the purpose of power connection. If a plurality of conventional gas transportation devices are disposed side by side to increase the amount of the transportation, it is difficult to control the assembly accuracy. The conducting pins are likely to cause obstacles for assembling, and wires provided for external connection are too complicated to be set up. Therefore, it is still difficult to increase the amount of the transportation by the above-mentioned methods, and the arrangement of the gas transportation devices cannot be flexibly applied.

Therefore, there is a need of providing a gas transportation device to solve the above-mentioned drawbacks in prior arts. The gas transportation device can make an apparatus or equipment utilize the conventional gas transportation device to achieve small size, miniaturization, and mute. The gas transportation device can also avoid the difficulty of controlling the dimensional accuracy and overcome the problem of the insufficient flow rate. The gas transportation device can be a miniature gas transportation device to be flexibly applied to various apparatus or equipment.

SUMMARY OF THE INVENTION

The object of the present disclosure is to provide a gas transportation device. The gas transportation device is miniaturized and is integrally produced into one piece by a micro-electromechanical process. The gas transportation device overcomes the problem that the conventional gas transportation device cannot have a small size, be miniaturized and avoid the difficulty of controlling the dimensional accuracy and the insufficient flow rate at the same time.

In accordance with an aspect of the present disclosure, a gas transportation device is provided. The gas transportation device includes a plurality of flow guiding units. Each of the flow guiding units includes an inlet plate, a substrate, a resonance plate, an actuating plate, a piezoelectric component, an outlet plate and at least one valve. The inlet plate has at least one inlet aperture. The resonance plate has a central aperture. A convergence chamber is formed between the resonance plate and the inlet plate. The actuating plate has a suspension part, an outer frame and at least one interspace. The piezoelectric component is attached on a surface of the suspension part of the actuating plate. The outlet plate has an outlet aperture. The at least one valve is disposed within at least one of the inlet aperture and the outlet aperture. The inlet plate, the substrate, the resonance plate, the actuating plate, the piezoelectric component and the outlet plate are sequentially stacked. A gap between the resonance plate and the actuating plate is formed as a first chamber. A second chamber is formed between the actuating plate and the outlet plate. While the piezoelectric component drives the actuating plate to generate a bending vibration in resonance, a pressure gradient is formed between the first chamber and the second chamber, the at least one valve is thus opened, and gas is inhaled into the convergence chamber via the inlet aperture of the inlet plate. Subsequently, the gas is transported into the first chamber via the central aperture of the resonance plate, is transported into the second chamber via the at least one interspace, and is then discharged out from the outlet aperture of the outlet plate. The gas is transported by the plurality of the flow guiding units disposed in a specific arrangement.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
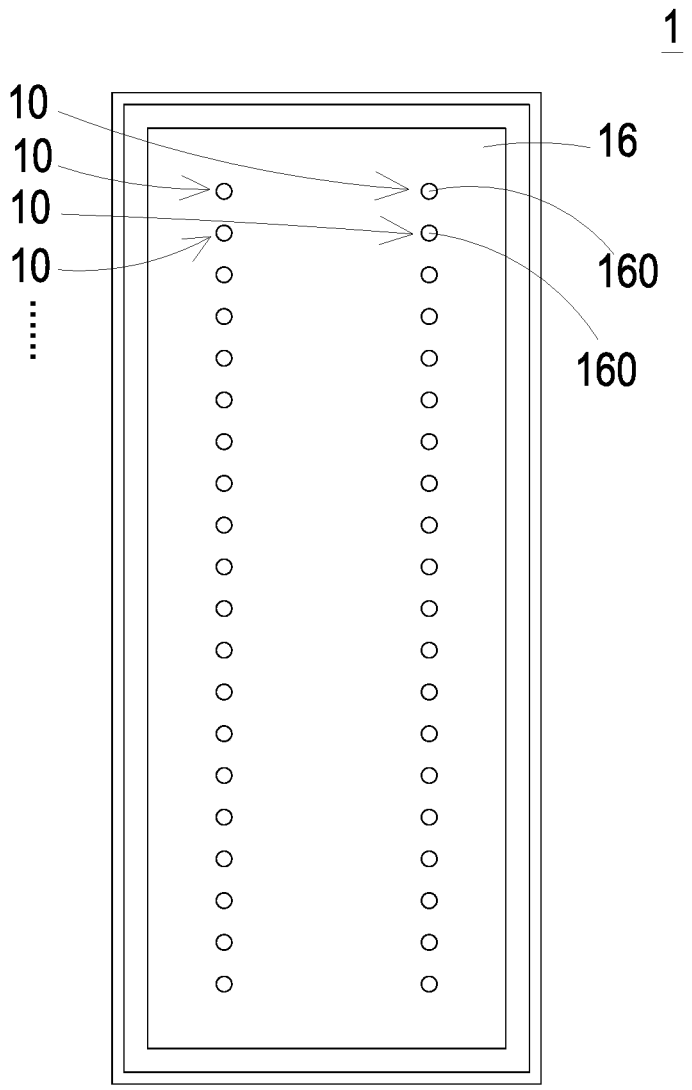
FIG. 1 is a schematic structural view illustrating a gas transportation device according to a first embodiment of the present disclosure.
Figure 2:
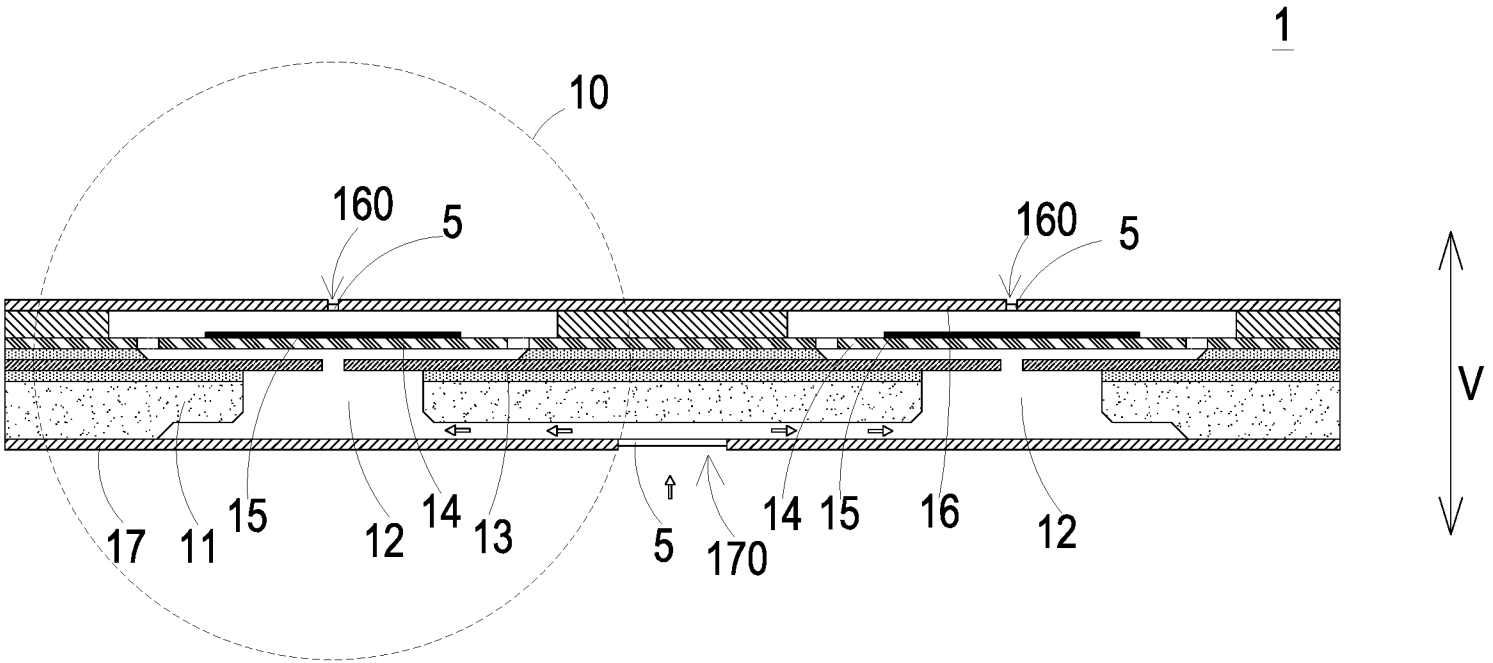
FIG. 2 is a schematic cross-sectional view illustrating the gas transportation device according to the first embodiment of the present disclosure.
Figure 3A:
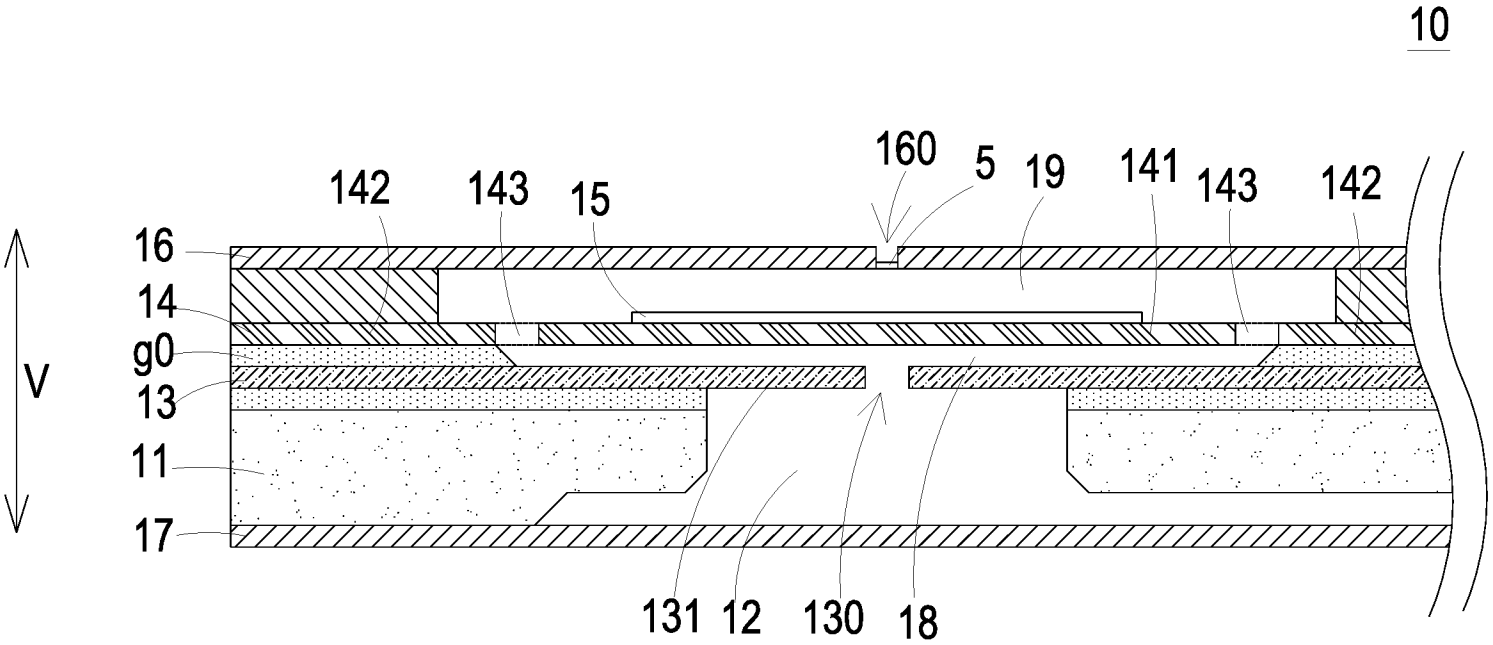
FIG. 3A is a fragmentary enlarged cross-sectional view illustrating a flow guiding unit of the gas transportation device.
Figure 3B:
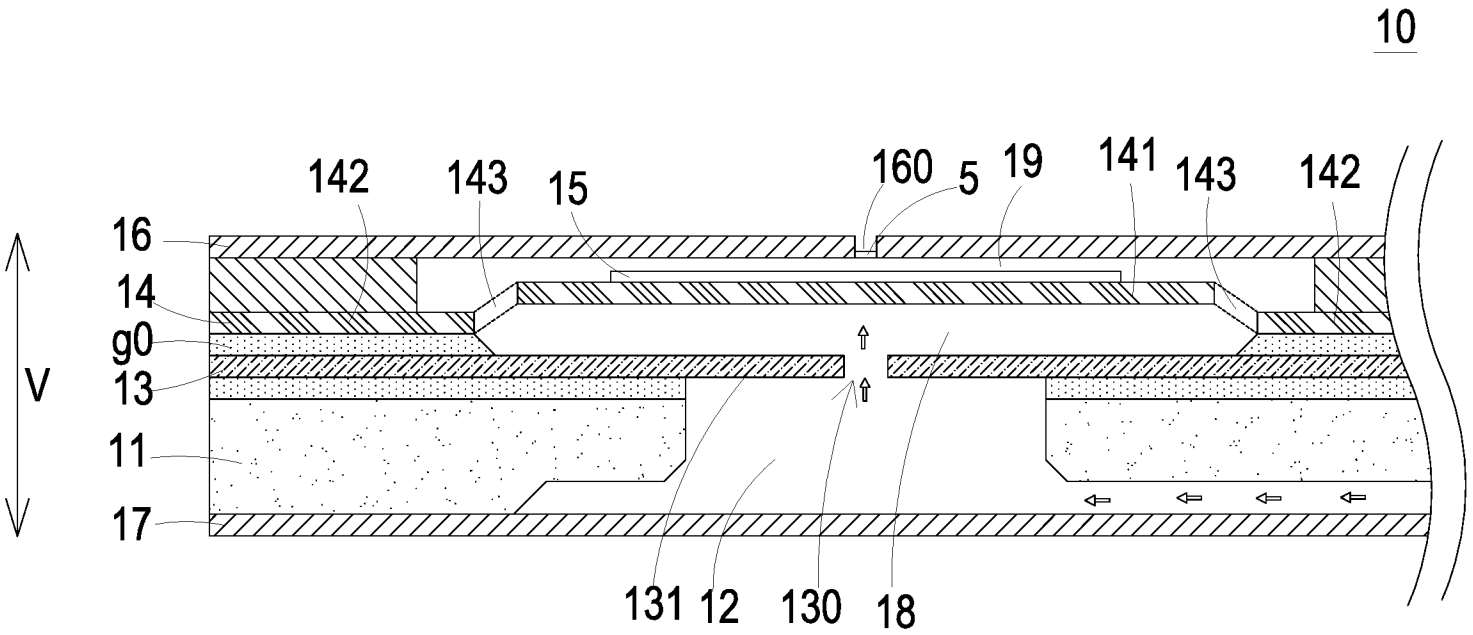
FIG. 3B to 3D are schematic diagrams illustrating the actuations of the flow guiding unit of the gas transportation device.
Figure 3C:
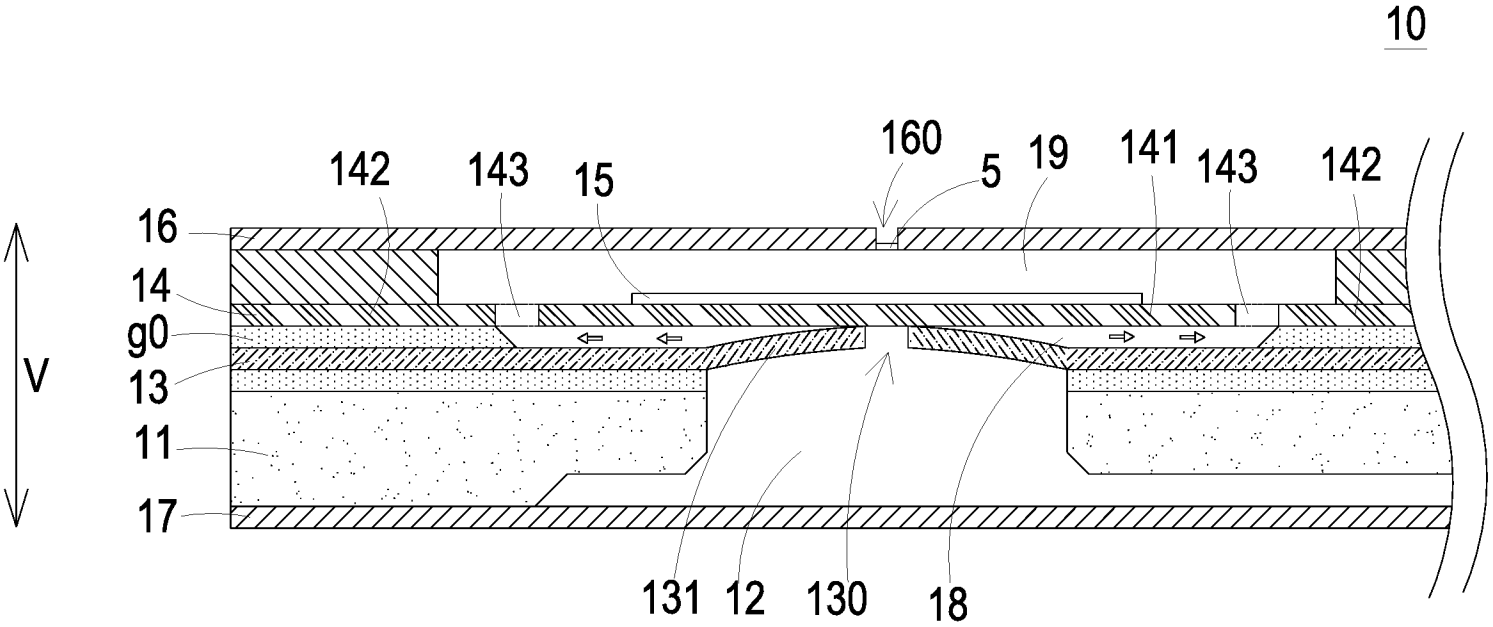
Figure 3D:
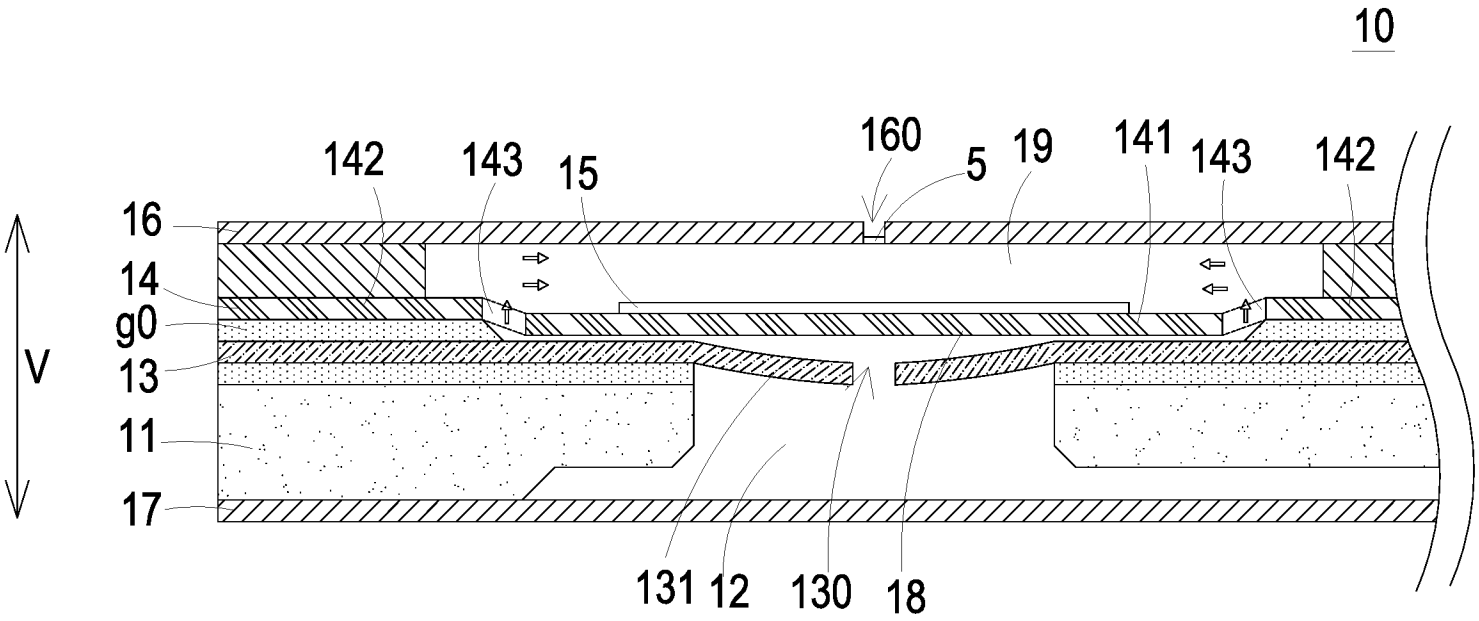

FIG. 1 is a schematic structural view illustrating a gas transportation device according to a first embodiment of the present disclosure. FIG. 2 is a schematic cross-sectional view illustrating the gas transportation device according to the first embodiment of the present disclosure. FIG. 3A is a fragmentary enlarged cross-sectional view illustrating a flow guiding unit of the gas transportation device. FIG. 3B to 3D are schematic diagrams illustrating the actuations of the flow guiding unit of the gas transportation device. Referring to FIGS. 1 to 3D, the present disclosure provides a gas transportation device 1 including a plurality of flow guiding units 10, at least one inlet plate 17 having at least one inlet aperture 170, at least one substrate 11, at least one resonance plate 13 having at least one central aperture 130, at least one convergence chamber 12, at least one actuating plate 14 having at least one suspension part 141, at least one outer frame 142 and at least one interspace 143, at least one piezoelectric component 15, at least one outlet plate 16 having at least one outlet aperture 160, at least one gap g0, at least one first chamber 18, at least one second chamber 19 and at least one pressure gradient. The numbers of the inlet plate 17, the substrate 11, the resonance plate 13, the central aperture 130, the convergence chamber 12, the actuating plate 14, the suspension part 141, the outer frame 142, the piezoelectric component 15, the outlet plate 16, the outlet aperture 160, the gap g0, the first chamber 18, the second chamber 19 and the pressure gradient are exemplified by one for each respectively in the following embodiments but not limited thereto. It is noted that each of the inlet plate 17, the substrate 11, the resonance plate 13, the central aperture 130, the convergence chamber 12, the actuating plate 14, the suspension part 141, the outer frame 142, the piezoelectric component 15, the outlet plate 16, the outlet aperture 160, the gap g0, the first chamber 18, the second chamber 19 and the pressure gradient can also be provided in plural numbers.

The present disclosure provides a gas transportation device 1 produced into one piece by a micro-electro-mechanical-system (MEMS) process, so as to overcome the problems that the conventional gas transportation device cannot have a small size, cannot be miniaturized and has insufficient flow rate at the same time, and to avoid the difficulty of controlling the dimensional accuracy. Referring to FIGS. 1, 2 and 3A, in a first embodiment, the gas transportation device 1 includes a plurality of flow guiding units 10 disposed in a specific arrangement. In the first embodiment, the flow guiding units 10 are arranged in 2 rows and 10 lines to form a rectangular flat structure. Each of the flow guiding units 10 includes an inlet plate 17, a substrate 11, a resonance plate 13, an actuating plate 14, at least one piezoelectric component 15 and an outlet plate 16 sequentially stacked on each other. The structure, the features and the disposition of each of the flow guiding units 10 will be further described in the following paragraph. In the first embodiment, the gas transportation device 1 is integrally formed into one piece by the micro-electro-mechanical-system (MEMS) process. The size of the gas transportation device 1 is small and thin, so that there is no need of stacking and machining the components as the conventional gas transportation device does. Consequently, the difficulty of controlling the dimensional accuracy is avoided, the quality of the product is stable, and the yield rate is high.

In the first embodiment, the inlet plate 17 has an inlet aperture 170. The resonance plate 13 has a plurality of central apertures 130 and a plurality of movable parts 131. A plurality of convergence chambers 12 are formed between the resonance plate 13 and the inlet plate 17. The actuating plate 14 has a plurality of suspension parts 141, a plurality of outer frames 142 and a plurality of interspaces 143. The outlet plate 16 has a plurality of outlet apertures 160. The inlet aperture 170 of the inlet plate 17, the plurality of convergence chambers 12 of the substrate 11, the plurality of central apertures 130 and the plurality of movable parts 131 of the resonance plate 13, the plurality of suspension parts 141 and the plurality of interspaces 143 of the actuating plate 14, a plurality of piezoelectric components 15 and the plurality of outlet apertures 160 of the outlet plate 16 collaboratively form the flow guiding units 10 of the gas transportation device 1. In other words, each of the flow guiding units 10 has one convergence chamber 12, one central aperture 130, one movable part 131, one suspension part 141, one interspace 143, one piezoelectric component 15 and one outlet aperture 160. The flow guiding units 10 share one inlet aperture 170, but not limited thereto. A gap g0 defined between the resonance plate 13 and the actuating plate 14 in each of the flow guiding units 10 forms a first chamber 18. A second chamber 19 is formed between the actuating plate 14 and the outlet plate 16 in each of the flow guiding units 10. In order to facilitate the description of the structure of the gas transportation device 1 and the manner of gas control, the following description will be proceeded with one flow guiding unit 10, but it is not limited to the present disclosure where there is only one flow guiding unit 10. The flow guiding units 10 having the same structure may be utilized to construct the gas transportation device 1, and the number thereof may be varied according to the practical requirements. In other embodiments of the present disclosure, each of the flow guiding units 10 may have one inlet aperture 170, but not limited thereto.

As shown in FIG. 1, in the first embodiment, the number of the flow guiding units 10 is 40. Namely, the gas transportation device 1 includes 40 flow guiding units 10, which can independently transport gas. The outlet apertures 160 respectively represent the flow guiding units 10. The 40 flow guiding units 10 are arranged in two rows, each of the two rows has 20 flow guiding units 10, and the two rows are juxtaposed from each other, but not limited thereto. The number and the arrangement thereof can be varied according to the practical requirements.

As shown in FIG. 2, the inlet aperture 170 extends through the inlet plate 17 and is disposed for allowing the gas to flow therethrough. In the first embodiment, the number of the inlet aperture 170 is one. In other embodiments, the number of the inlet aperture 170 may be more than one, but not limited thereto. The number and the arrangement of the inlet aperture 170 may be varied according to the practical requirements. In the first embodiment, the inlet plate 17 further has a filter device (not shown), but not limited thereto. The filter device is sealingly disposed within the inlet aperture 170 for filtering the dust in the gas, or filtering the impurities in the gas. Consequently, the damages of the inner components caused by the impurities and the dust can be prevented.

In the first embodiment, the substrate 11 includes a driving circuit (not shown) electrically connected to the anode and the cathode of the piezoelectric component 15 so as to provide a driving power, but not limited thereto. In other embodiments, the driving circuit may be disposed at any position within the gas transportation device 1. The present disclosure is not limited thereto and the disposed position of the driving circuit may be varied according to the practical requirements.

Referring to FIGS. 2 and 3A, in the first embodiment, the resonance plate 13 has a suspension structure. The central aperture 130 10 is located at the center of the movable part 131 and extends through the resonance plate 13. The convergence chamber 12 is in communication with the first chamber 18 through the central aperture 130, so as to transport the gas. In the first embedment, the movable part 131 is a flexible structure. In response to a vibration of the actuating plate 14, the movable part 131 is driven to undergo a bending vibration so as to transport the gas. The actuations of the resonance plate 13 and the actuating plat 14 will be further described in the following.

Referring to FIGS. 2 and 3A, in the first embodiment, the actuating plate 14 is made of a metallic membrane or a polysilicon membrane, but not limited thereto. The actuating plate 14 has a hollow and suspension structure. Each of the flow guiding units 10 has one suspension part 141. The suspension part 141 is connected to the outer frame 142 via a plurality of connection parts (not shown), so that the suspension part 141 is suspended and elastically supported by the outer frame 142. The interspaces 143 are defined between the suspension part 141 and the outer frame 142 and are disposed for allowing the gas to flow therethrough. The disposition, the types and the numbers of the suspension part 141, the outer frame 142 and the interspaces 143 may be varied according to the practical requirements, but not limited thereto. In the first embodiment, the suspension part 141 has a stepped structure. Namely, the suspension part 141 has a bulge (not shown). The bulge is, for example, but not limited to a circular convex structure, and is formed on a first surface of the suspension part 141. With the disposition of the bulge, a depth of the first chamber 18 is maintained at a specific value. In this way, it is possible to avoid the problem that while the movable part 131 of the resonance plate 13 vibrates, the movable part 131 may collide the actuating plate 14 to generate the noise due to the depth of the first chamber 18 being too small. Moreover, it also avoids the problem of insufficient gas transportation pressure due to the depth of the first chamber 18 being too large. The present disclosure is not limited thereto.

Referring to FIGS. 2 and 3A, in the first embodiment, each of the flow guiding units 10 includes one piezoelectric component 15. The piezoelectric component 15 is attached on a second surface of the suspension part 141 of the actuating plate 14. The piezoelectric component 15 generates a deformation in response to an applied voltage, so as to drive the actuating plate 14 to vibrate in a vertical direction (V) in a reciprocating manner. The vibration of the actuating plate 14 drives the resonance plate 13 to vibrate in resonance. In this way, a pressure gradient occurs in first chamber 18 between the resonance plate 13 and the actuating plate 14 so as to transport the gas.

Referring to FIGS. 1 to 3A, in the first embodiment, each of the flow guiding units 10 has one outlet aperture 160. The second chamber 19 is in communication with the exterior of the gas transportation device 1 through the outlet aperture 160 so as to allow the gas to flow from the second chamber 19 to the exterior of the gas transportation device 1.

Referring to FIGS. 3A to 3D. Firstly, as shown in FIG. 3A, the flow guiding unit 10 is in an initial state, where the piezoelectric component 15 is not driven. The gap g0 between the resonance plate 13 and the actuating plate 14 allows the gas to flow more rapidly. The contact interference between the suspension part 141 and the resonance plate 13 can be reduced by maintaining a proper distance between the resonance plate 13 and the actuating plate 14, and the generated noise can thereby be largely reduced, but the present disclosure is not limited thereto.

As shown in FIGS. 2 and 3B, when the piezoelectric component 15 is driven in response to the applied voltage, the actuating plate 14 is driven by the piezoelectric component 15, and the suspension part 141 of the actuating plate 14 vibrates away from the inlet plate 17 to enlarge the volume of the first chamber 18 and to reduce the pressure in the first chamber 18. Thus, the gas is inhaled via the inlet aperture 170 of the inlet plate 17 in accordance with the external pressure, and is then converged into the convergence chamber 12 of the substrate 11. Afterward, the gas flows into the first chamber 18 via the central aperture 130 of the resonance plate 13. As shown in FIGS. 2 and 3C, the movable part 131 of the resonance plate 13 is driven to vibrate away from the inlet plate 17 in resonance with the vibration of the suspension part 141 of the actuating plate 14, and the suspension part 141 of the actuating plate 14 also vibrates toward the inlet plate 17 at the same time. In such a manner, the movable part 131 of the resonance plate 13 is attached against to the suspension part 141 of the actuating plate 14, and the central aperture 130 of the resonance plate 13 is closed simultaneously. Consequently, the first chamber 18 is compressed to reduce the volume thereof and increase the pressure therein, and the pressure in the second chamber 19 is increased. Under this circumstance, the pressure gradient occurs to push the gas in the first chamber 18 to move toward a peripheral portion of the first chamber 18, and to flow into the second chamber 19 through the interspaces 143 of the actuating plate 14.

Furthermore, as shown in FIGS. 2 and 3D, the suspension part 141 of the actuating plate 14 vibrates toward the inlet plate 17 and drives the movable part 131 of the resonance plate 13 to vibrate toward the inlet plate 17, so as to further compress the first chamber 18. As a result, most of the gas is transported into the second chamber 19 and is temporarily stored in the second chamber 19.

Finally, the suspension part 141 of the actuating plate 14 vibrates away from the inlet plate 17 to compress the volume of the second chamber 19 and to increase the pressure in the second chamber 19. Thus, the gas stored in the second chamber 19 is discharged out the gas transportation device 1 through the outlet aperture 160 of the outlet plate 16 so as to accomplish a gas transportation process. By repeating the actuations as illustrated in FIGS. 3B to 3D, the purpose of gas transportation is achieved.

In this way, the pressure gradient is generated in the flow channels of each of the flow guiding units 10 of the gas transportation device 1 so as to transport the gas at a high speed. Moreover, since there is an impedance difference between the inlet direction and the outlet direction, the gas can be transported from an inhale end to a discharge end of the gas transportation device 1. Even if a gas pressure exists at the discharge end, the gas can still be discharged while achieving the silent efficacy. In other embodiments, the vibration frequency of the resonance plate 13 may be the same as the vibration frequency of the actuating plate 14. Namely, both of the resonance plate 13 and the actuating plate 14 may moves in the same direction at the same time. The processing actuations can be adjustable according to the practical requirements, but not limited to that of the embodiments.

In the first embodiment, the 40 flow guiding units 10 of the gas transportation device 1 is applicable to various electronic components since the flexibility of the gas transportation device 1 is high, and is applicable to multiple arrangement designs and multiple driving circuit connections. In addition, the 40 flow guiding units 10 can be driven to simultaneously transport the gas, so as to meet the requirement of transporting the gas at a large flow rate. Moreover, each of the flow guiding units 10 can also be controlled to work individually. For example, one part of the flow guiding units 10 is driven and the other part of the flow guiding units 10 is not driven. Alternatively, one part of the flow guiding units 10 and the other part of the flow guiding units 10 may work by turns, but not limited thereto. Thus, it facilitates to meet various gas transportation requirements easily and achieve a significant reduction in power consumption.

Figure 4:
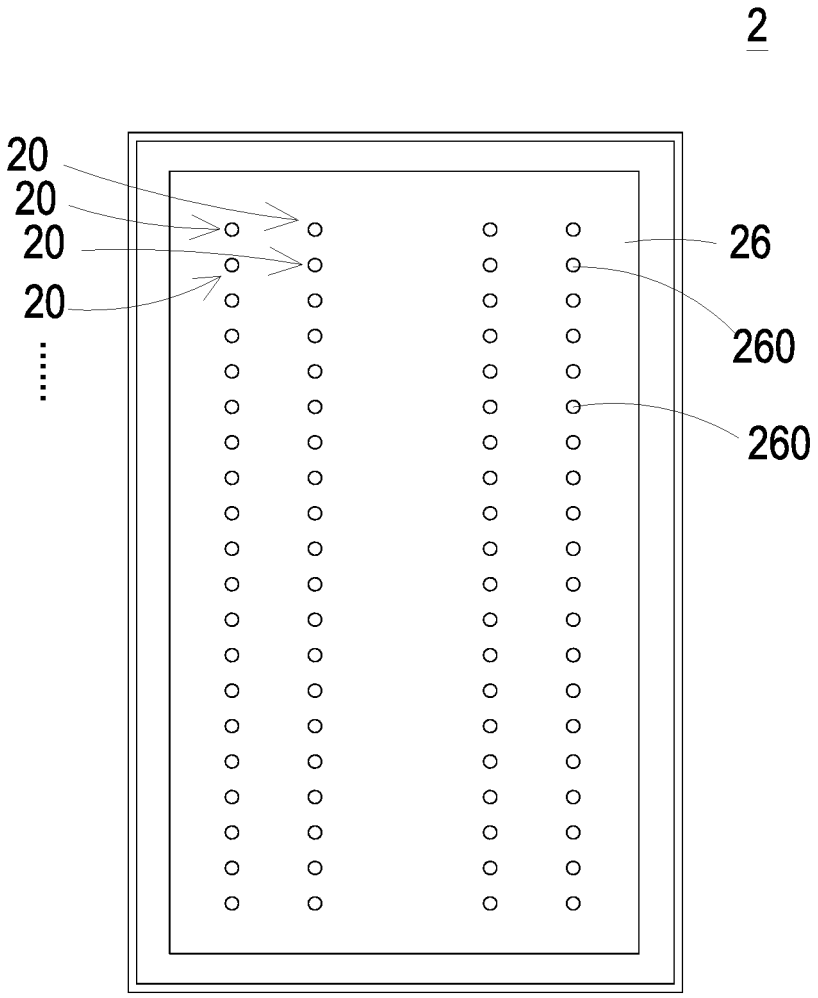
FIG. 4 is a schematic structural view illustrating the gas transportation device according to a second embodiment of the present disclosure.

FIG. 4 is a schematic structural view illustrating the gas transportation device according to a second embodiment of the present disclosure. Referring to FIG. 4, in a second embodiment of the present disclosure, the structure of each of the flow guiding units 20 of the gas transportation device 2 is similar to the structure of each of the flow guiding units 10 of the gas transportation device 1 in the first embodiment except the number and the arrangement of the flow guiding units 20. The structure of each of the flow guiding units 20 will therefore be omitted hereafter. In the second embodiment, the number of the flow guiding units 20 is 80. The outlet apertures 260 of the outlet plate 26 respectively represent the flow guiding units 20. In other words, the gas transportation device 2 includes 80 flow guiding units 20, which can be controlled to individually transport the gas. In the second embodiment, the 80 flow guiding units 20 are also arranged in four rows, each of the four rows has 20 flow guiding units 20, and the four rows are juxtaposed from each other, but not limited thereto. The number and the arrangement of the 80 flow guiding units 20 may be varied according to the practical requirements. By simultaneously driving the 80 flow guiding units 20 to transport the gas, a greater value of the gas transportation flow rate compared with the first embodiment can be achieved. Moreover, each of the flow guiding units 20 can also be driven to individually transport the gas, and thereby controlling the gas transportation flow rate in a wider range. Therefore, the gas transportation device 2 is more flexible and applicable to all types of apparatuses that requires to transport a great amount of gas, but not limited thereto.

Figure 5:
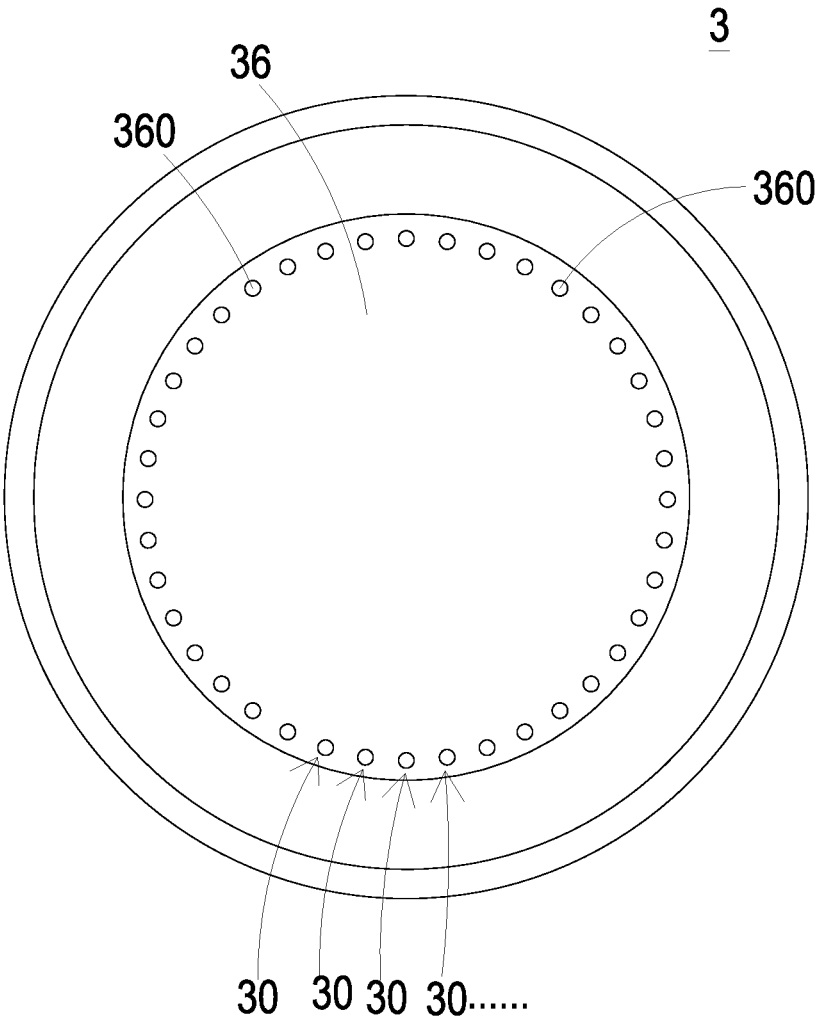
FIG. 5 is a schematic structural view illustrating the gas transportation device according to a third embodiment of the present disclosure.

FIG. 5 is a schematic structural view illustrating the gas transportation device according to a third embodiment of the present disclosure. Referring to FIG. 5, in a third embodiment of the present disclosure, the structure of each of the flow guiding units 30 of the gas transportation device 3 is similar to the structure of each of the flow guiding units 10 of the gas transportation device 1 in the first embodiment and the structure of each of the flow guiding units 20 of the gas transportation device 2 in the second embodiment except the number and the arrangement of the flow guiding units 30. The structure of each of the flow guiding units 30 will therefore be omitted hereafter. In the third embodiment, the gas transportation device 3 has a circular structure and includes 40 flow guiding units 30. The outlet apertures 360 of the outlet plate 36 respectively represent the flow guiding units 30. In other words, each of the 40 flow guiding units 30 can be controlled to individually transport the gas. In the third embodiment, the 40 flow guiding units 30 are annularly arranged so that the gas transportation device 3 can be applied in various round or circular gas transportation channels. The number and the arrangement of the 40 flow guiding units 30 may be varied according to the practical requirements. By changing the arrangement of the flow guiding units 30, it facilitates the application of the gas transportation device to meet various shapes of the required devices and to be more flexible and applicable to various gas transportation devices.

Figure 6:
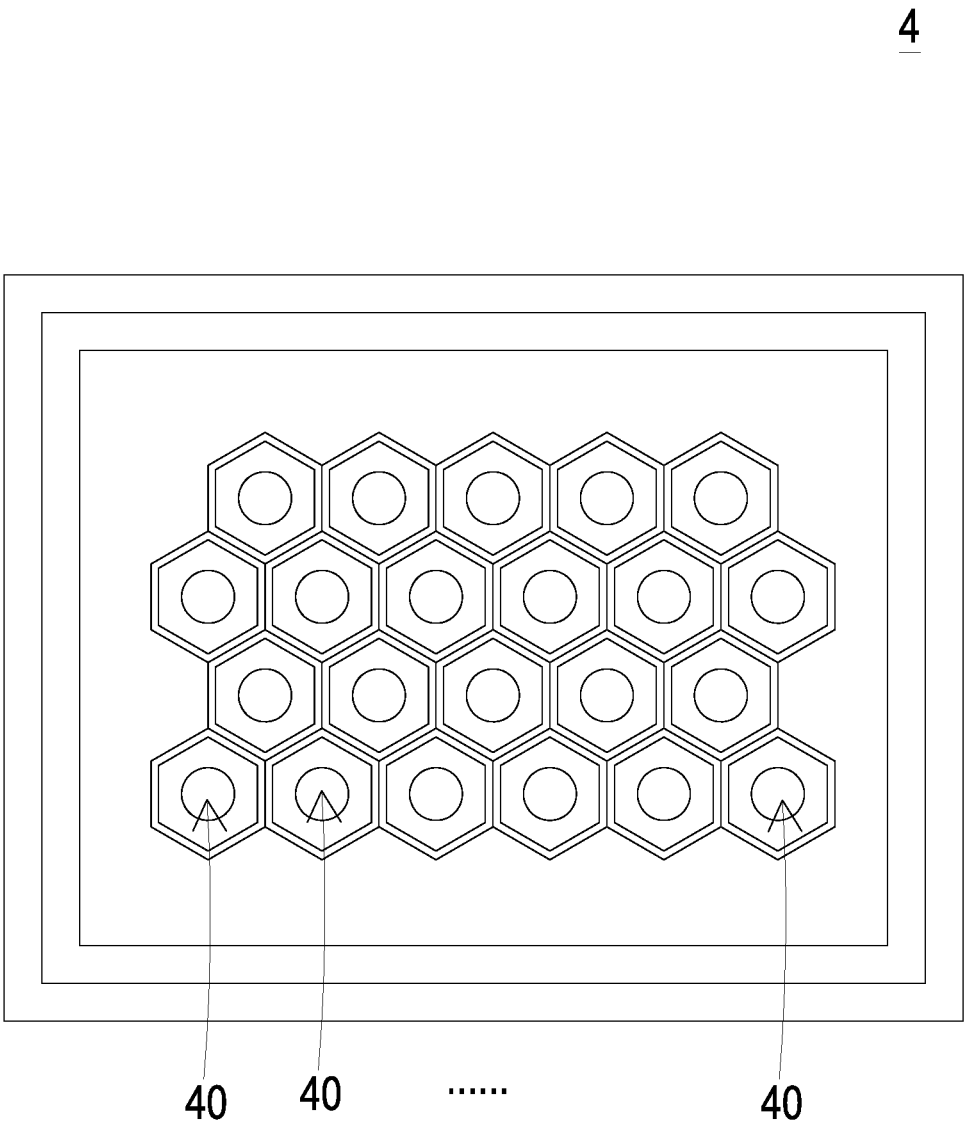
FIG. 6 is a schematic structural view illustrating the gas transportation device according to a fourth embodiment of the present disclosure.

FIG. 6 is a schematic structural view illustrating the gas transportation device according to a fourth embodiment of the present disclosure. Referring to FIG. 6, in a fourth embodiment of the present disclosure, the structure of each of the flow guiding units 40 of the gas transportation device 4 is similar to the structure of each of the flow guiding units of the gas transportation device in the foregoing embodiments except the number and the arrangement of the flow guiding units 40. The structure of each of the flow guiding units 40 will therefore be omitted hereafter. In the fourth embodiment, the flow guiding units 40 are arranged in a honeycomb pattern.

Referring back to FIGS. 2, and 3A, the gas transportation device 1 further includes at least one valve 5. The at least one valve 5 is disposed within the inlet aperture 170 or the outlet aperture 160 of the gas transportation device 1. Alternatively, the at least one valve 5 may be disposed in the inlet aperture 170 and the outlet aperture 160 at the same time.

Figure 7A:
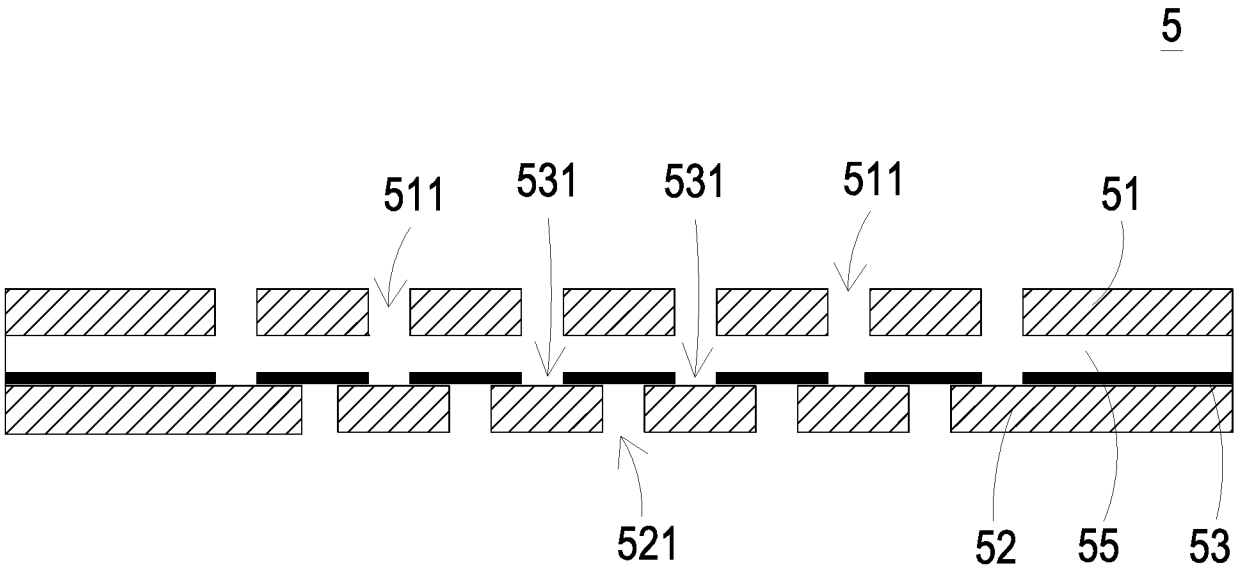
FIGS. 7A and 7B are schematic diagrams illustrating the actuations of a valve of the gas transportation device according to the first, second and third embodiments of the present disclosure.
Figure 7B:
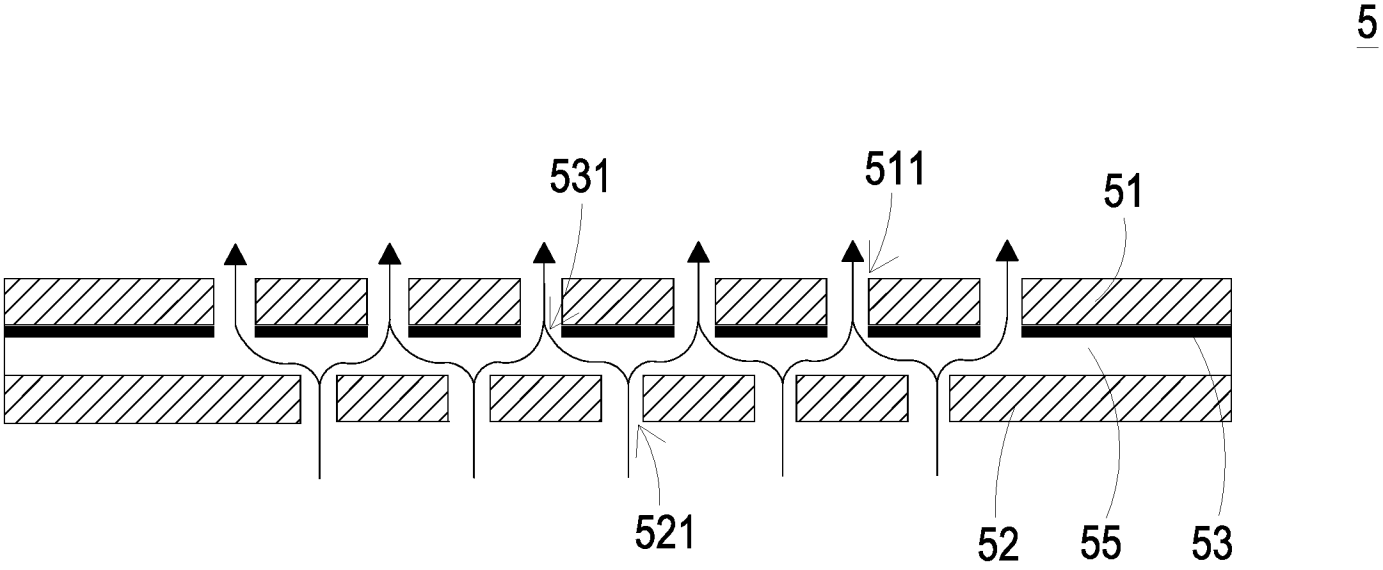

FIGS. 7A and 7B are schematic diagrams illustrating the actuations of a valve of the gas transportation device according to the first, second and third embodiments of the present disclosure. Referring to FIGS. 7A and 7B, a first aspect of the at least one valve 5 includes a stationary component 51, a sealing component 52 and a valve plate 53. The valve plate 53 is disposed within an accommodation space 55 formed between the stationary component 51 and the sealing component 52. The stationary component 51 has at least two first orifices 511. The valve plate 53 has at least two second orifices 531 respectively corresponding in position to the at least two first orifices 511 of the stationary component 51. The sealing component 52 has at least one third orifice 521. The at least one third orifice 521 of the sealing component 52 is misaligned with the at least two first orifices 511 of the stationary component 51 and the at least two second orifices 531 of the valve plate 53.

Referring to FIGS. 3D, 7A and 7B, in the first aspect of the at least one valve 5, the at least one valve 5 is disposed within the inlet aperture 170 of the inlet plate 17. While the gas transportation device 1 is driven, the gas is inhaled into the gas transportation device 1 through the inlet aperture 170 of the inlet plate 17. At this time, a suction force is generated inside the gas transportation device 1 and the valve plate 53 is in an inlet state as shown in FIG. 7B. The gas is then transported in a direction indicated by arrows in FIG. 7B to bias the valve plate 53 toward the stationary component 51. As a result, the valve plate 53 comes into contact with the stationary component 51 so as to open the third orifices 521 of the sealing component 52 at the same time, and the gas is inhaled through the third orifices 521 of the sealing component 52. Since the second orifices 531 of the valve plate 53 are aligned with the first orifices 511 of the holding component 51, respectively, the second orifices 531 and the first orifices 511 are in communication with each other. The gas is thus transported into the gas transportation device 1. While the actuating plate 14 of the gas transportation device 1 vibrates toward the inlet plate 17, the first chamber 18 is compressed and the volume of the first chamber 18 is reduced, so that the gas is transported into the second chamber 19 through the interspaces 143. Meanwhile, the valve plate 53 of the valve 5 is biased by the gas and the first orifices 511 of the stationary component 51 returns back to the position as shown in FIG. 7A. The gas is thus transported unidirectionally to enter into the convergence chamber 12 and be accumulated in the convergence chamber 12. In this way, while the actuating plate 14 of the gas transportation device 1 vibrates away from the inlet plate 17, more gas can be discharged out through the outlet aperture 160, so as to increase the amount of output gas.

The stationary component 51, the sealing component 52 and the valve plate 53 of the at least one valve 5 are made of graphene and form a miniature valve. In a second aspect of the at least one valve 5, the valve plate 53 is made of a charged material, and the stationary component 51 is made of a bipolar conductive material. The stationary component 51 is electrically connected to a control circuit 100, so that the change electrical polarity (positive polarity or negative polarity) of the stationary component 51 can be controlled by the control circuit 100. In case that the valve plate 53 is made of a negative charged material, while the at least one valve 5 is required to be opened, the stationary component 51 is in positive polarity in response to the control of the control circuit 100. Since the valve plate 53 and the stationary component 51 are maintained in reversed polarities, the valve plate 53 moves toward the stationary component 51 to open the at least one valve 5. In contrast, in case that the valve plate 53 is made of the negative charged material, while the at least one valve 5 is required to be closed, the stationary component 51 is in negative polarity in response to the control of the control circuit 100. Since the valve plate 53 and the stationary component 51 are maintained in identical polarities, the valve plate 53 moves toward the sealing component 52 to close the at least one valve 5.

In a third aspect of the at least one valve 5, the valve plate 53 is made of a magnetic material, and the stationary component 51 is made of an electromagnet material. The stationary component 51 is electrically connected to the control circuit 100, so that the electrical polarity (positive polarity or negative polarity) of the stationary component 51 is controlled by the control circuit 100. In case that the valve plate 53 is made of a negative-magnetic material, while the at least one valve 5 is required to be opened, the stationary component 51 is in positive polarity in response to the control of the control circuit 100. Since the valve plate 53 and the stationary component 51 are maintained in reversed polarities, the valve plate 53 moves toward the stationary component 51 to open the at least one valve 5. In contrast, in case that the valve plate 53 is made of a negative-magnetic material, while the at least one valve 5 is required to be closed, the stationary component 51 is in negative polarity in response to the control of the control circuit 100. Since the valve plate 53 and the stationary component 51 are maintained in identical polarities, the valve plate 53 moves toward the sealing component 52 to close the at least one valve 5.

Figure 8A:
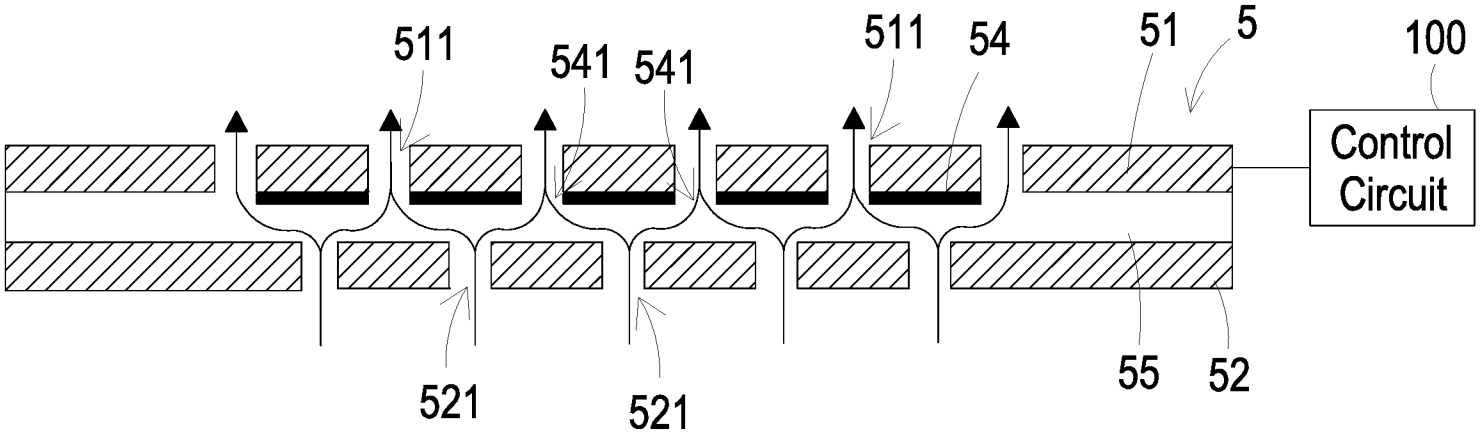
FIGS. 8A and 8B are schematic diagrams illustrating the actuations of the valve according to the fourth and fifth embodiments of the present disclosure.
Figure 8B:
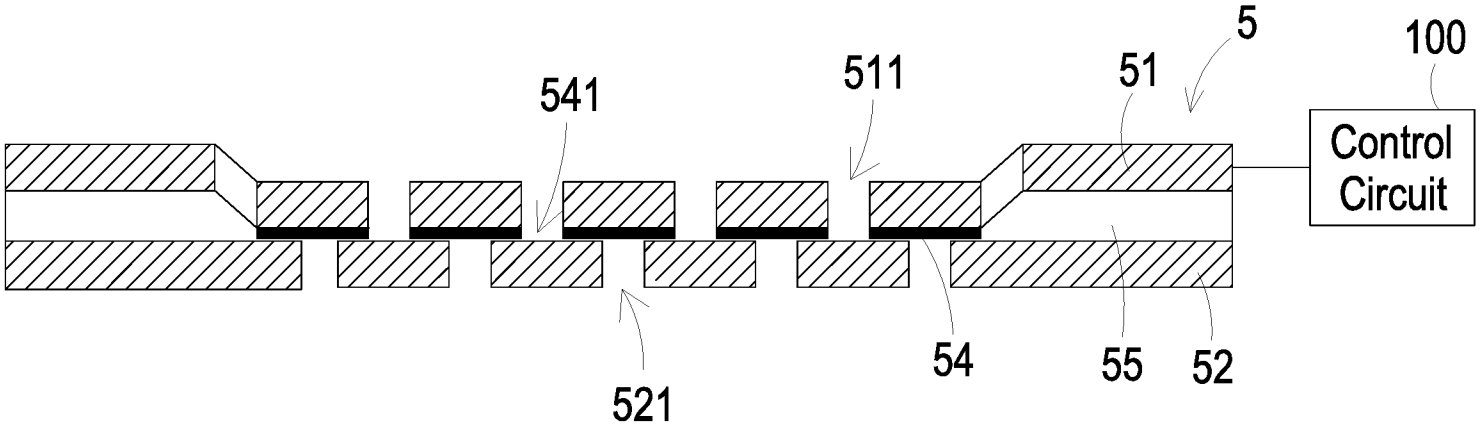

FIGS. 8A and 8B are schematic diagrams illustrating the actuations of the valve according to the fourth and fifth embodiments of the present disclosure. Referring to FIGS. 8A and 8B, in a fourth aspect of the at least one valve 5, the at least one valve 5 includes the stationary component 51, the sealing component 52 and a flexible membrane 54. The stationary component 51 has at least two first orifices 511. An accommodation space 55 is formed between the stationary component 51 and the sealing component 52. The flexible membrane 54 is made of a flexible material, is attached on a surface of the stationary component 51, and is disposed within the accommodation space 55. The flexible membrane 54 has at least two second orifices 541 respectively corresponding in position to the at least two first orifices 511 of the stationary component 51. The sealing component 52 has at least one third orifice 521. The at least one third orifice 521 of the sealing component 52 is misaligned with the at least two first orifices 511 of the stationary component 51 and the at least two second orifices 541 of the flexible membrane 54.

Referring to FIGS. 8A and 8B, in the fourth aspect of the at least one valve 5, the stationary component 51 is made of a thermal expansion material and is electrically connected to the control circuit 100. The control circuit 100 is disposed for controlling the stationary component 51 to be heated. While the at least one valve 5 is required to be opened, the stationary component 51 is free of thermal expansion in response to the control of the control circuit 100 and the accommodation space 55 between the stationary component 51 and the sealing component 52 is maintained in a specific volume to open the at least one valve 5. In contrast, while the valve 5 is required to be closed, the stationary component 51 is heated to expand in response to the control of the control circuit 100, and moves toward and comes into contact with the sealing component 52. As a result, the flexible membrane 54 is in closely contact with the at least one third orifice 521 of sealing component 52 to close the at least one valve 5.

Referring to FIGS. 8A and 8B, in a fifth aspect of the at least one valve 5, the stationary component 51 is made of a piezoelectric material and is controlled by the control circuit 100 to deform. While the at least one valve 5 is required to be opened, the stationary component 51 is free of deformation in response to the control of the control circuit 100 and the accommodation space 55 between the stationary component 51 and the sealing component 52 is maintained in the specific volume to open the at least one valve 5. In contrast, while the at least one valve 5 is required to be closed, the stationary component 51 is deformed in response to the control of the control circuit 100, and moves toward and comes into contact with the sealing component 51. As a result, the flexible membrane 54 is in closely contact with the at least one third orifice 521 of the sealing component 52 to close the at least one valve 5. In addition, the sealing component 52 may have a plurality of third orifices 521, and each of spacing blocks of the stationary component 51 that respectively correspond in position to the third orifices 521 of the sealing component 52 may be independently controlled by the control circuit 100 so as to form transportation actuations of an adjustable valve 5. Therefore, the efficacy of an adjustable flow rate of the gas can be achieved.

In summary, the present disclosure provides a gas transportation device including a plurality of flow guiding units. With the actuations of the flow guiding units, the pressure gradient is generated to allow the gas to flow rapidly. The flow guiding units are disposed in the specific arrangement to adjust the flow rate of the gas transportation. In addition, by driving the actuating plate with the piezoelectric component, the pressure gradient is generated in the designed flow channels and the pressure chambers, so as to facilitate the gas to flow at the high speed. The gas is transported from the inlet end to the outlet end to accomplish the gas transportation. Furthermore, the number, the arrangement and the driving modes of the flow guiding units can be varied flexibly according to the practical requirements of various gas transportation apparatuses and various flow rates. It facilitates to achieve the efficacies of high transportation quantity, high performance and high flexibility. Moreover, with the disposition of the valve, the gas can be efficiently converged, and the gas can be accumulated in the chamber with the limited volume to achieve the effect of increasing the gas output quantity.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device comprising:

a plurality of flow guiding units having at least one inlet aperture, wherein each of the flow guiding units includes:

an inlet plate, wherein the at least one inlet aperture is disposed on the inlet plate;

a substrate;

a resonance plate having a central aperture, wherein a convergence chamber is formed between the resonance plate and the inlet plate;

an actuating plate having a suspension part, an outer frame and at least one interspace;

a piezoelectric component attached on a surface of the suspension part of the actuating plate;

an outlet plate having at least one outlet aperture; and at least one valve disposed within at least one of the at least one inlet aperture and the at least one outlet aperture, wherein the inlet plate, the substrate, the resonance plate, the actuating plate, the piezoelectric component and the outlet plate are sequentially stacked, a gap between the resonance plate and the actuating plate is formed as a first chamber, and a second chamber is formed between the actuating plate and the outlet plate, wherein while the piezoelectric component drives the actuating plate to generate a bending vibration in resonance, a pressure gradient is formed between the first chamber and the second chamber, and gas is inhaled into the convergence chamber via the at least one inlet aperture of the inlet plate, wherein the gas is subsequently transported into the first chamber via the central aperture of the resonance plate, is transported into the second chamber via the at least one interspace, and is then discharged out from the at least one outlet aperture of the outlet plate, and wherein the gas is transported by the plurality of flow guiding units, wherein the gas transportation device is produced by a micro-electro-mechanical-system (MEMS) process, wherein the at least one valve includes a stationary component, a sealing component and a valve plate, wherein the valve plate is made of a charged material, and the stationary component is made of a bipolar conductive material, the stationary component is controlled by a control circuit to change electrical polarity, wherein an accommodation space is formed between the stationary component and the sealing component, and the valve plate is disposed within the accommodation space, wherein the stationary component has at least two first orifices, and the valve plate has at least two second orifices respectively corresponding in position to the at least two first orifices, wherein the sealing component has at least one third orifice misaligned with the at least two first orifices and the at least two second orifices, wherein while the valve plate and the stationary component are maintained in opposing polarities, the valve plate moves close to the stationary component so as to open the at least one valve, and while the valve plate and the stationary component are maintained in identical polarities, the valve plate moves close to the sealing component so as to close the at least one valve.

2. The gas transportation device according to claim 1, wherein the plurality of the flow guiding units are arranged in a column.

3. The gas transportation device according to claim 1, wherein the plurality of the flow guiding units are arranged in a row.

4. The gas transportation device according to claim 1, wherein an arrangement of the flow guiding units is an annular arrangement.

5. The gas transportation device according to claim 1, wherein an arrangement of the flow guiding units is a honeycomb arrangement.

* * * * *